US005465839A

United States Patent [19]

Gretz

[11] Patent Number: 5,465,839

[45] Date of Patent: Nov. 14, 1995

[54] GOLF BAG FORMED FROM INTERLOCKING TUBES

[75] Inventor: Jon J. Gretz, Springfield, Tenn.

[73] Assignee: Wilson Sporting Goods Co., Chicago, Ill.

[21] Appl. No.: 297,129

[22] Filed: Aug. 29, 1994

Related U.S. Application Data

[63] Continuation of Ser. No. 114,639, Sep. 2, 1993, abandoned.

[51] Int. Cl.[6] ..... A63B 55/00

[52] U.S. Cl. ..... 206/315.3; 206/315.5; 206/315.6

[58] Field of Search ..... 206/315.2–315.6; 280/DIG. 6; 211/70.2; 248/96; 220/23.4, 23.8

[56] References Cited

U.S. PATENT DOCUMENTS

| | | | |
|---|---|---|---|
| 1,563,816 | 12/1925 | Worthington | 206/315.2 |
| 1,951,492 | 3/1934 | Schneider . | |
| 2,722,258 | 11/1955 | Smidt et al. | 206/315.6 |
| 2,938,559 | 5/1960 | Harkrader . | |
| 2,950,748 | 8/1960 | Olinghouse | 206/315.2 X |
| 3,101,108 | 8/1963 | Ingoldt | 206/315.6 X |
| 3,164,185 | 1/1965 | Ingoldt | 206/315.2 X |
| 3,172,681 | 3/1965 | Moses . | |
| 3,495,641 | 2/1970 | Bethel | 220/23.8 X |
| 3,543,355 | 12/1970 | Wyckoff et al. | 211/70.2 |
| 3,985,229 | 10/1976 | Maki | 206/315.6 |
| 3,996,983 | 12/1976 | Isnardi . | |
| 4,142,563 | 3/1979 | Ackerfeldt et al. | 206/315.5 |
| 4,332,283 | 6/1982 | Rader | 206/315.6 |
| 4,542,930 | 9/1985 | Adams | 220/23.4 X |
| 4,932,523 | 6/1990 | Yamazoe | 206/315.6 |

FOREIGN PATENT DOCUMENTS

| | | | |
|---|---|---|---|
| 653650 | 12/1962 | Canada | 206/315.5 |
| 2220493 | 2/1973 | Germany . | |
| 2434089 | 1/1976 | Germany | 220/23.4 |
| 3306348 | 8/1984 | Germany | 220/23.4 |
| 996730 | 6/1965 | United Kingdom | 280/DIG. 6 |
| 1038401 | 8/1966 | United Kingdom | 206/315.2 |
| 2233910 | 1/1991 | United Kingdom | 280/DIG. 6 |

*Primary Examiner*—Sue A. Weaver

[57] ABSTRACT

A golf bag is formed from a plurality of elongated tubes which are interconnected by male and female connectors. Each tube is generally rectangular in transverse cross section and includes two channel-shaped female connectors on two sides thereof and two male projecting connectors on the other two sides. The bag can include outer panels and one or more pockets which include male or female connectors which interconnect with complementary connectors on the tubes.

17 Claims, 2 Drawing Sheets

GOLF BAG FORMED FROM INTERLOCKING TUBES

RELATED APPLICATION

This application is a continuation of my prior application Ser. No. 08/114,639, filed Sep. 2, 1993, now abandoned.

BACKGROUND

This invention relates to golf bags, and, more particularly, to a golf bag which is formed from a plurality of interlocking tubes.

Golf bags commonly include an outer tube which defines the bag and top and bottom caps. The top cap can be provided with dividers so that groups of clubs can be stored independently.

Some golf bags include a plurality of elongated tubes for holding individual clubs to protect the shaft and grip of each club. Such bags are shown, for example, in U.S. Pat. Nos. 2,722,258, 3,101,108, and 4,332,283. However, such tubes generally do not improve the structural integrity of the bag, and the tubes sometimes become loose and rattle.

SUMMARY OF THE INVENTION

The invention provides a golf bag which is formed from a plurality of interlocking tubes. Each tube includes male and female connecting members which interlock with complementary male and female connecting members on adjacent tubes. The interlocked tubes provide a lightweight, rigid structure which does not require any additional frame or support structure to maintain the structural integrity of the bag. Side panels and/or pockets can be connected to the tubes by complementary male or female connecting members. The tubes and connecting members are advantageously extruded integrally from plastic.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
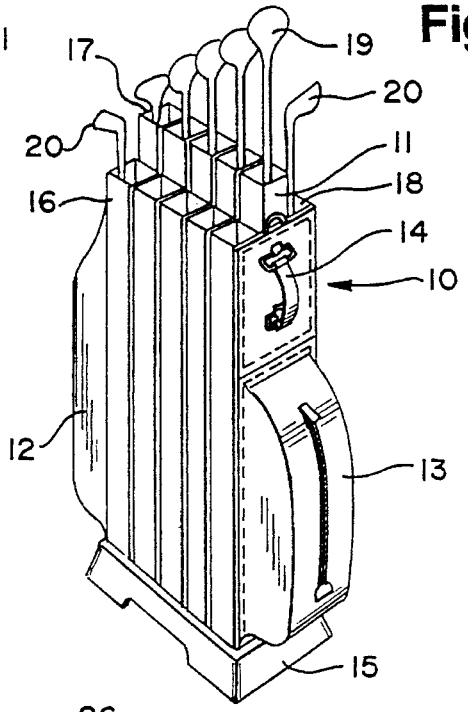
FIG. 1 is a perspective view of a golf bag formed in accordance with the invention.

Referring to FIG. 1, a golf bag 10 includes a plurality of elongated tubes 11, a pair of pockets 12 and 13, a handle 14, and a base 15. The tubes are arranged in three rows 16, 17, and 18, each row containing four tubes. The tubes of the middle row 17 are longer than the other tubes and are sized to receive wood-type clubs 19 or low-numbered irons. The tubes of the outer rows 16 and 18 can have the same or different length, and are sized to receive iron clubs 20. If desired, the lengths of the tubes in each row can be graduated to correspond with the varying lengths of different numbered clubs.

Figure 3:
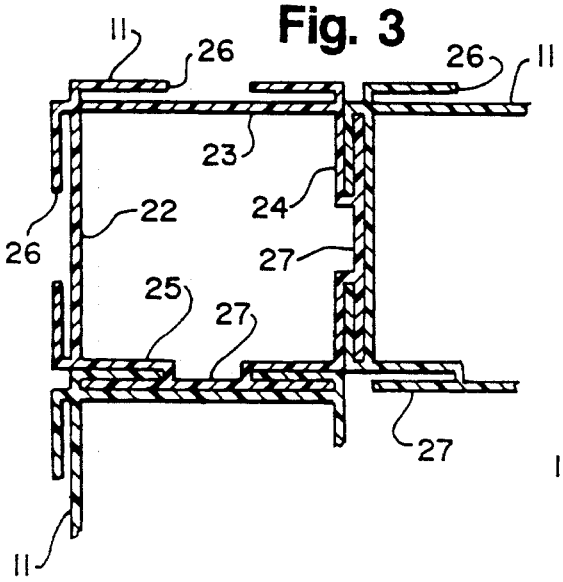
FIG. 3 is a fragmentary sectional view taken along the line 3—3 of FIG. 2.
Figure 2:
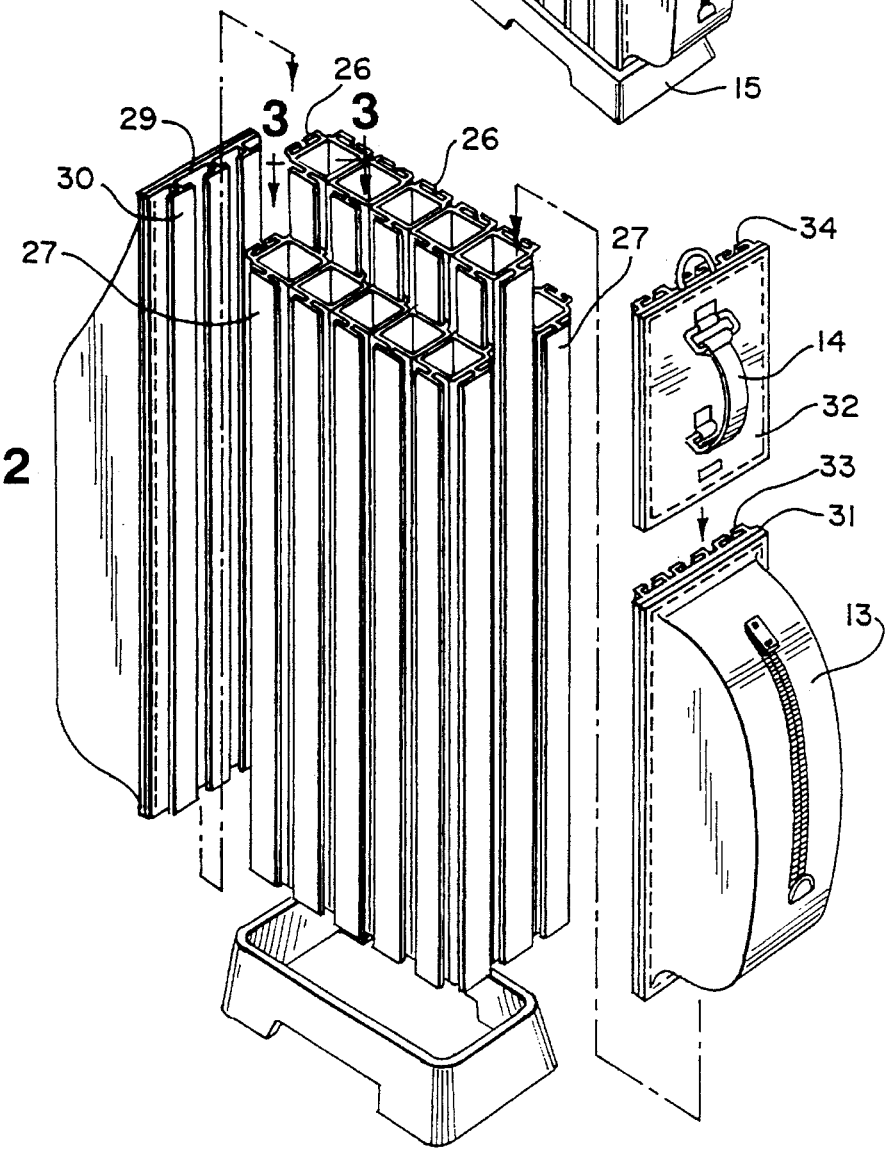
FIG. 2 is a fragmentary exploded view of the golf bag of FIG. 1.

As can be seen in FIGS. 2 and 3, each of the tubes is rectangular in transverse cross section and includes four sides 22, 23, 24, and 25. Adjacent sides 22 and 23 include channels 26 which extend longitudinally along the length of the tube, and adjacent sides 24 and 25 include T-shaped projections 27 which extends longitudinally along the length of the tube. The T-shaped projections 27 on each tube are male connecting members which are sized to slide within the channels 26 on adjacent tubes, which are female connecting members. Each tube is thereby interconnected with the adjacent tube on each side of the tube.

The male projection fits snugly within the female channel, and the tubes are firmly interconnected in a rigid, rattle-free manner along their entire lengths. There is therefore no need for the conventional top cap which is normally required to confine club tubes and to support the tube or sleeve which forms the outside of a conventional bag. The base 15 is suitably secured to the bottom ends of the tubes and merely serves to close the bottom ends and prevent relative sliding movement of the tubes. The base is not required for maintaining the rigidity or structural integrity of the bag. Alternatively, the base can be omitted and the bottom end of each tube can be closed by an individual plug or closer member for each tube.

The pocket 12 is mounted on a panel 29 which includes three T-projections 30. The pocket panel 29 is secured to the tubes by sliding the T-projections 30 into the channels 26 on the end tubes of the three rows of tubes. Similarly, the pocket 13 and the handle 14 are mounted on panels 31 and 32 which include three channels 33 and 34, respectively. The panels 31 and 32 are connected to the tubes by interfitting the channels 33 and 34 on the panels with the T-projections 27 on the tubes.

Figure 4:
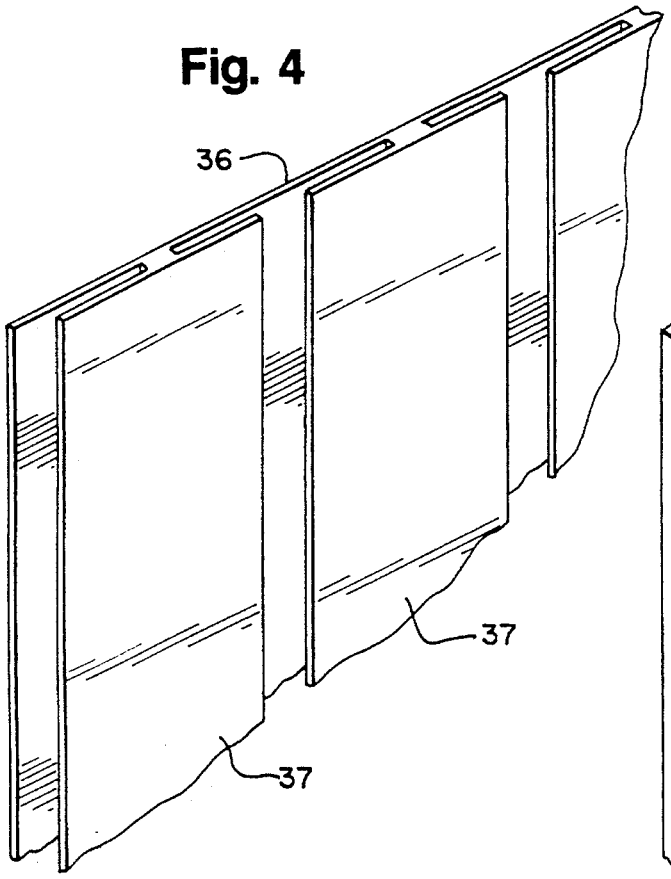
FIG. 4 is a fragmentary perspective view of a side panel with male connecting members.

If desired, side panels can be attached to the four tubes which comprise row 16 and the four tubes which comprise row 18 in a similar fashion. FIG. 4 illustrates a side panel 36 which is equipped with a plurality of T-projections 37 for interconnecting with the channels 26 on the tubes of row 18. The sheet is advantageously extruded from plastic so that the flat outer surface of the sheet and the T-projections are integrally formed. Before the panel is attached to the tubes, pockets or other accessories can be suitably attached to the panel, as by adhesives, riveting, etc.

Figure 5:
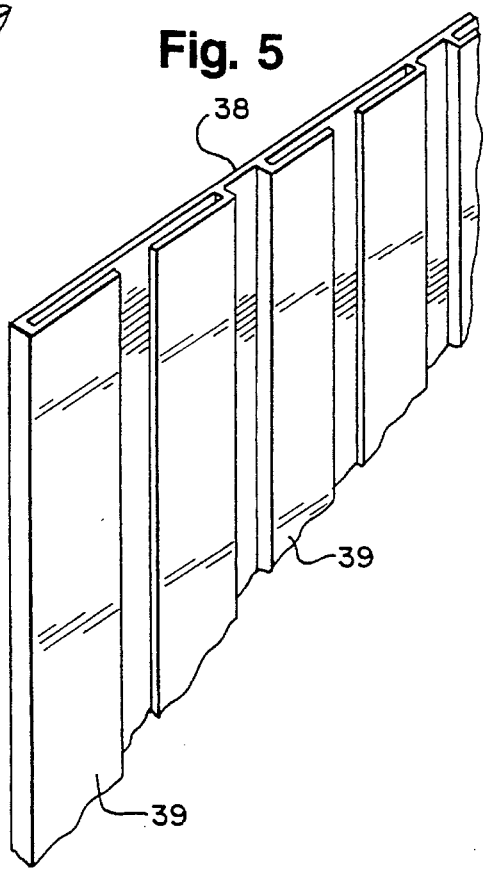
FIG. 5 is a fragmentary perspective view of a side panel with female connecting members.

FIG. 5 illustrates a side panel 38 which is equipped with channels 39 for interconnecting with the tubes of row 16. The sheet 38 can also be formed by extrusion.

Figure 6:
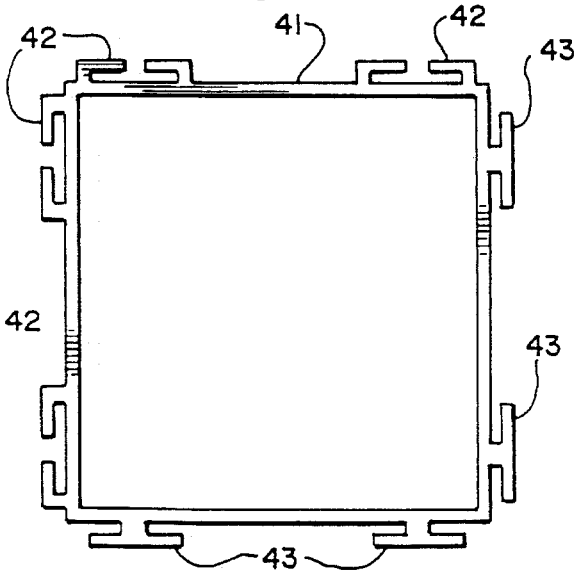
FIG. 6 is a top plan view of a tube with another embodiment of connecting members.

FIG. 6 illustrates a modified embodiment of a tube 41. The tube includes a pair of female connecting channels 42 on two adjacent sides thereof and a pair of male T-connectors 43 on the other two adjacent sides. The male connectors 43 are sized to slide snugly within the female connectors 42 of adjacent tubes.

Figure 7:
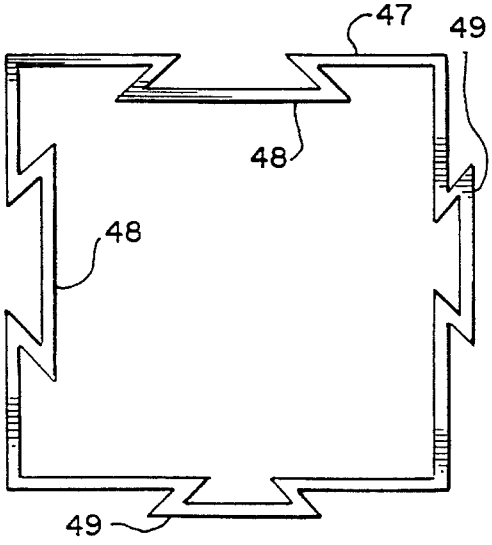
FIG. 7 is a top plan view of a tube with still another embodiment of connecting members.

Still another embodiment of a tube 45 is illustrated in FIG. 7. Two adjacent sides are provided with inwardly extending or recessed trapezoidal or dovetail-shaped channels 48, and the other two sides are provided with complementary shaped male projections 49.

Each of the tubes 11, 41, and 47 are advantageously formed by extruding from plastic, and the extrusion can be made in any desired length. Alternatively, a long extruded tube can be cut into individual tubes of desired lengths.

In addition to providing stronger structural integrity, the interlocked tubes provide the ability to attach pockets, handles, and other accessories to the assembled tubes. The panels which support the pockets or accessories and the side panels 36 and 38 can be covered with suitable covering material, nylon, vinyl, etc., before the panels are attached to the tubes.

Any desired number of tubes can be interlocked, and the shape of the interlocked tubular structure can be modified as desired. The interlocking tubes therefore permit creation of modular golf bags without the need for snaps, zippers, sewing, or other attaching devices for the pockets, accessories, and side panels. Further, a bag which includes 14 or 15 tubes for carrying a conventional set of clubs can be converted to a "Sunday" bag for carrying a fewer number of clubs merely by removing the desired number of tubes. The tubes can be readily removed or added if the bottom end of each tube is separately closed by a suitable plug.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf bag comprising a plurality of interconnected elongated tubes, each of the tubes including connecting means integral with the tube and extending along the length of the tube on at least two sides thereof for connecting the tube to adjacent tubes, the tubes forming a rigid self-standing golf bag that does not require any additional frame or support structure to maintain its structural integrity.

2. The golf bag of claim 1 in which each of the tubes is rectangular in transverse cross section.

3. The golf bag in claim 2 in which each of the tubes includes connecting means on four sides thereof.

4. The golf bag of claim 3 in which two of the connecting means includes a female channel-shaped element and two of the connecting means includes a male projection which is sized to be inserted into a female element of an adjacent tube.

5. The golf bag of claim 1 in which one of the connecting means includes a female channel-shaped element and the other of the connecting means includes a male projection which is sized to be inserted into a female element of an adjacent tube.

6. The golf bag of claim 1 in which each of the tubes and the connecting means thereof are extruded integrally from plastic.

7. The golf bag of claim 1 in which each of the tubes is sized to receive a single golf club.

8. A golf bag comprising a plurality of interconnected elongated tubes, each of the tubes including connecting means extending along the length of the tube on at least two sides thereof for connecting the tube to adjacent tubes, and a side panel and connecting means on the side panel which is connected to the connecting means of at least one of the tubes.

9. A golf bag comprising a plurality of interconnected elongated tubes, each of the tubes including connecting means extending along the length of the tube on at least two sides thereof for connecting the tube to adjacent tubes, and a pocket and connecting means on the pocket which is connected to the connecting means of at least one of the tubes.

10. A golf bag comprising a plurality of rows of elongated tubes, each of the tubes having a rectangular transverse cross section and four sides, female channel-shaped connectors integral with two of the sides of each tube, male connectors integral with the other two sides of each tube, the male connector being adapted to be inserted into the female connectors of adjacent tubes, each of the tubes being connected to an adjacent tube by male and female connectors, the tubes forming a rigid self-standing golf bag that does not require any additional frame or support structure to maintain its structural integrity.

11. The golf bag of claim 10 in which each of said female connectors includes a female channel-shaped element and each of the male connectors includes a projection which is sized to be inserted into a female channel-shaped element of an adjacent tube.

12. The golf bag of claim 10 in which each of said tubes is connected to every adjacent tube by male and female connectors.

13. The golf bag of claim 10 in which the golf bag includes at least two rows of a plurality of elongated tubes, each of said rows including a pair of end tubes and at least one intermediate tube between the end tubes, each of the end tubes of each row being connected to an intermediate tube in the same row and an end tube in the other row by male and female connectors, each of the intermediate tubes of each row being connected to two adjacent tubes in the same row and to an intermediate tube in the other row by male and female connectors.

14. The golf bag of claim 10 in which each of the tubes and the male and female connectors thereof are extruded integrally from plastic.

15. The golf bag of claim 10 in which each of the tubes is sized to receive a single golf club.

16. A golf bag comprising a plurality of rows of a plurality of elongated tubes, each of the tubes having a rectangular transverse cross section and four sides, female channel-shaped connectors on two of the sides of each tube, male connectors on the other two sides of each tube, the male connector being adapted to be inserted into the female connectors of adjacent tubes, each of the tubes being connected to an adjacent tube by male and female connectors, and a side panel and means on the side panel for slidably connecting to a male or female connector of at least one of the tubes.

17. A golf bag comprising a plurality of rows of a plurality of elongated tubes, each of the tubes having a rectangular transverse cross section and four sides, female channel-shaped connectors on two of the sides of each tube, male connectors on the other two sides of each tube, the male connector is being inserted into the female connectors of adjacent tubes, each of the tubes being connected to an adjacent tube by male and female connectors, and a pocket and means on the pocket for slidably connecting to a male or female connector of at least one of the tubes.

* * * * *